US005087920A

United States Patent [19]

Tsurumaru et al.

[11] Patent Number: 5,087,920

[45] Date of Patent: Feb. 11, 1992

[54] MICROWAVE ANTENNA

[75] Inventors: Shinobu Tsurumaru, Kanagawa; Keiji Fukuzawa, Chiba; Fumihior Ito, Tokyo, all of Japan

[73] Assignee: Sony Corporation, Tokyo, Japan

[21] Appl. No.: 223,781

[22] Filed: Jul. 25, 1988

[30] Foreign Application Priority Data

| | | | |
|---|---|---|---|
| Jul. 30, 1987 | [JP] | Japan | 62-190771 |
| Aug. 31, 1987 | [JP] | Japan | 62-217577 |
| Oct. 23, 1987 | [JP] | Japan | 62-267697 |
| Dec. 11, 1987 | [JP] | Japan | 62-313476 |
| Dec. 15, 1987 | [JP] | Japan | 62-317070 |
| Dec. 15, 1987 | [JP] | Japan | 62-317071 |
| Dec. 16, 1987 | [JP] | Japan | 62-317990 |

[51] Int. Cl.[5] ..... H01Q 1/38; H01Q 1/42

[52] U.S. Cl. ..... 343/700 MS; 343/786; 343/872

[58] Field of Search ..... 343/700 MS, 769, 771, 343/777, 778, 799, 797, 872

[56] References Cited

U.S. PATENT DOCUMENTS

| | | | |
|---|---|---|---|
| 4,063,246 | 12/1977 | Greiser | 343/700 MS |
| 4,072,951 | 2/1978 | Kaloi | 343/700 MS |
| 4,170,013 | 10/1979 | Black | 343/700 MS |
| 4,197,544 | 4/1980 | Kaloi | 343/700 MS |
| 4,291,312 | 9/1981 | Kaloi | 343/700 MS |
| 4,460,894 | 7/1984 | Robin et al. | 343/700 MS |
| 4,614,947 | 9/1986 | Rammos | 343/778 |
| 4,626,865 | 12/1986 | Rammos | 343/786 |
| 4,755,820 | 7/1988 | Backhouse et al. | 343/700 MS |
| 4,772,890 | 9/1988 | Bowen et al. | 343/700 MS |

FOREIGN PATENT DOCUMENTS

| | | | |
|---|---|---|---|
| 0108463 | 5/1984 | European Pat. Off. . | |
| 0123350 | 10/1984 | European Pat. Off. | 343/700 MS |
| 0215240 | 3/1987 | European Pat. Off. . | |
| 0253128 | 1/1988 | European Pat. Off. . | |
| 2387527 | 11/1978 | France . | |
| 0160104 | 12/1981 | Japan | 343/700 MS |
| 0181706 | 10/1984 | Japan | 343/700 MS |

OTHER PUBLICATIONS

1987 International Symposium Digest Antennas and Propagation, "A Low-Profile Antenna For DBS Reception", Jun. 15-19, 1987, pp. 914-917.

*Primary Examiner*—Rolf Hille
*Assistant Examiner*—Hoanganh Le
*Attorney, Agent, or Firm*—Hill, Van Santen, Steadman & Simpson

[57] ABSTRACT

A suspended line feed type planar array antenna has a substrate sandwiched between a pair of metal or metallized plastic plates and resonance type printed patch radiators provided in corresponding relation to openings formed through one of the pair of metal or metallized plastic plates, whereby the antenna can be reduced in thickness, weight and cost. Also, the transmission loss of the antenna can be reduced and its bandwidth can be widened.

15 Claims, 9 Drawing Sheets

MICROWAVE ANTENNA

SUMMARY OF THE INVENTION

1. Field of the Invention

This invention relates generally to circular planar array antennas and, more particularly, to a planar type microwave antenna for use in receiving, for example, a satellite broadcast, and so on.

2. Description of the Prior Art

In a suspended line feed type planar antenna in which a substrate is sandwiched between metal or metallized plastic plates having a number of openings forming parts of radiation elements, a circular polarized wave planar array antenna has been proposed. In this previously proposed antenna, a pair of resonance probes which are perpendicular to each other, the number of which corresponds to the number of openings, are formed on a common plane and signals fed to the pair of resonance probes are mixed in phase within the suspended line (See our co-pending U.S. patent applications Ser. No. 888,117 filed on July 22, 1986, and Ser. No. 58,286 filed on June 4, 1987).

Thus, the above-mentioned planar antenna can be reduced in thickness as compared with the existing one, and also its mechanical configuration can be simplified. Further, an inexpensive substrate now available on the market can be employed for high frequency use, achieving antenna gain equal to or greater than that of a planar antenna using an expensive microstrip line substrate.

The suspended line achieves such advantages in that it forms a low loss line as a circuit for feeding the planar antenna, and also in that it can be formed on an inexpensive film shaped substrate, and so on. Further, since this conventional planar antenna utilizes a circular or rectangular waveguide opening element as a radiation element, it is possible to construct an array antenna which has a small gain deviation over a relatively wide frequency range.

Meanwhile, a patch type microstrip line antenna element is proposed, in order to reduce the thickness of the planar array antenna. FIGS. 1A and 1B, forming a top view and a side view, generally illustrate an example of a circular patch type microstrip line antenna.

As FIGS. 1A and 1B show, this circular patch type microstrip line antenna comprises a base plate 1, a dielectric 2 having relative dielectric constant $\epsilon_r$ and a printed element 3 as a patch. In this arrangement, its resonance frequency is substantially determined by the diameter D of the printed element 3. When a feed line and a radiation element are formed on the same plane, there occurs such contradiction that while the feed line has a small radiation loss, the radiation efficiency of the radiation element has to be increased. Thus, the characteristic of the patch type microstrip line antenna shown in FIGS. 1A and 1B is regarded as having narrow bandwidth (antenna gain) characteristics. See IEEE Transactions on antennas & propagation, Vol. AP-29, No. 1, Jan., '81 which was issued as "A collection of technical papers and application notes on microstrip antennas and arrays".

Further, it is proposed to increase the bandwidth, i.e., the antenna gain, by adding a non-feeding element or the like by use of a multi-layer substrate and so on. See IEEE transaction on antennas & propagation, Vol. AP-27, No. 2, March '79, PP. 270 to 273. FIG. 2 illustrates an example of such a known planar antenna as described hereinabove.

Referring to FIG. 2 forming a side view thereof, there is provided a circular planar array antenna which comprises a base plate 1, a dielectric 2, a printed element 3 forming a patch, which are similar to those shown in FIGS. 1A and 1B, a dielectric air space 4, a printed element 5 as a non-feeding element and a dielectric 6.

For the circuit polarized planar array antenna, it is proposed to increase the axial ratio by making a group of several elements and varying the signal phases (spatial phase and phase of the feed line) to be fed to each element of the group.

In the case of the above-mentioned circular polarized planar array antenna disclosed in the foregoing U.S. patent application Ser. Nos. 888,117 and 58,286, the thickness of the radiation element (almost equal to the thickness of first and second metal plates) is selected to fall in a range of about 2 to 2.5 cm, causing the antenna made of metal to weigh 6.5 kg (a square of 40 cm×40 cm), or the antenna made of metallized plastic material to weigh 2 to 3 kg (a square of 40 cm×40 cm). Thus, the above-mentioned antenna can be reduced neither in weight nor in thickness without difficulty. Also, from a marketability standpoint, this antenna is not attractive as a product because it is hard to handle. If this antenna is made of a metallized plastic material, a mold core for molding the same is required, and hence the antenna becomes expensive. Further, in this case, the antenna may be warped and not uniform in quality so that this antenna cannot be mass-produced efficiently. In addition, if this type of antenna is made of metal, difficult cutting work cannot be avoided which makes the efficient mass-production of the antenna impossible. Also, this makes the antenna expensive.

Further, in the case of the patch type microstrip line array antenna shown in FIGS. 1A and 1B, in order to increase the bandwidth or antenna gain, the relative dielectric constant $\epsilon_r$ of the dielectric 2 should be decreased and the thickness of the substrate, i.e., the thickness h of the dielectric 2 has to be increased, contradictorily. The relative dielectric constant $\epsilon_r$ in this case is as large as 2 to 2.5. Besides, if the thickness of the substrate is increased, the radiation loss of the feed line is increased with the result that the thickness of the substrate is naturally limited. In conclusion, the gain characteristic of this conventional circular patch type microstrip line array antenna is brought about with a bandwidth as narrow as, for example, about 200 MHz.

Further, since the conventional antenna shown in FIG. 2 employs a plurality of substrates, it becomes complicated in configuration and it becomes expensive from a money standpoint.

At any rate, with the microstrip line structures shown in FIGS. 1A and 1B and FIG. 2, the transmission loss is relatively large regardless of the employment of the substrate having low relative dielectric constant and low transmission loss. Therefore, the radiation element must be improved to have a wide bandwidth.

OBJECTS AND SUMMARY OF THE INVENTION

Accordingly, it is an object of the present invention to provide a circular patch-slot array antenna.

It is another object of the present invention to provide a circular patch-slot array antenna which effectively utilizes features of the suspended line and thin radiation elements to provide high efficiency and wide bandwidth.

It is a further object of the present invention to provide a circular patch-slot array antenna which can be reduced in thickness and weight.

According to an aspect of the present invention, there is provided a circular patch slot array antenna having a substrate sandwiched between a pair of metal or metallized plastic plates, wherein resonance type printed patch radiators are provided on the substrate at positions corresponding to slots formed through one of the metal or metallized plastic plates.

In accordance with the circular patch-slot array antenna of the present invention, the substrate is sandwiched between the pair of metal or metallized plastic plates. The resonance type printed patch radiators are formed on the substrate at positions corresponding to slots formed through one of the metal or metallized plastic plates. Thus, the circular patch-slot array antenna of the invention can be reduced both in thickness and weight. Also, according to the circular patch-slot array antenna of the present invention, the transmission loss can be reduced and the frequency band can be widened.

BRIEF DESCRIPTION OF THE DRAWINGS

A better understanding of the objects, features and advantages of the invention can be gained from a consideration of the following detailed description of the preferred embodiments thereof, in conjunction with the figures of the accompanying drawings, wherein.

DETAILED DESCRIPTION OF THE PREFERRED EMBODIMENTS

Now, an embodiment of a circular patch-slot planar array antenna according to the present invention will hereinafter be described with reference to FIGS. 3 to 8.

Figure 1A:
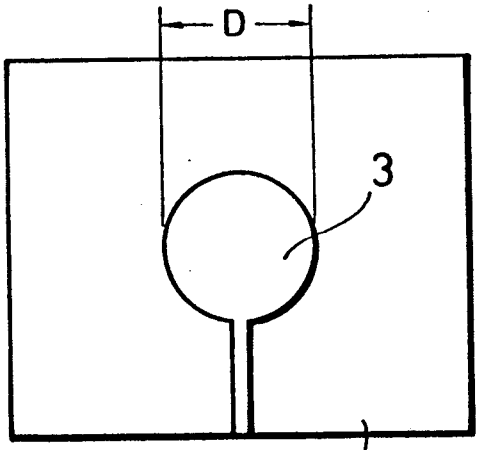
FIG. 1A (PRIOR ART)
FIG. 1A is a top view of an example of a conventional patch type microstrip line antenna.
Figure 1B:
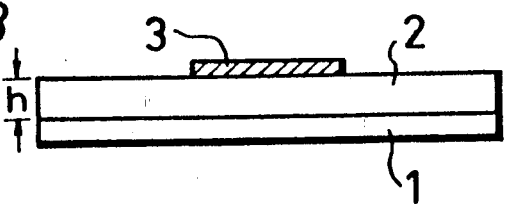
FIG. 1B (PRIOR ART)
FIG. 1B is a side view thereof.
Figure 2:
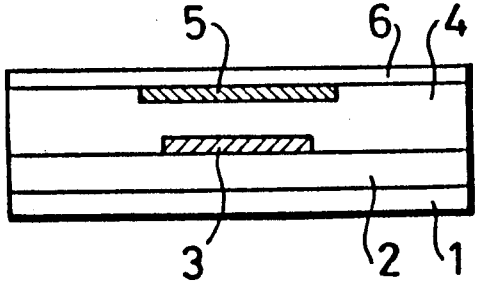
FIG. 2 (PRIOR ART)
FIG. 2 is a side view of another example of a known patch type microstrip line antenna.
Figure 3A:
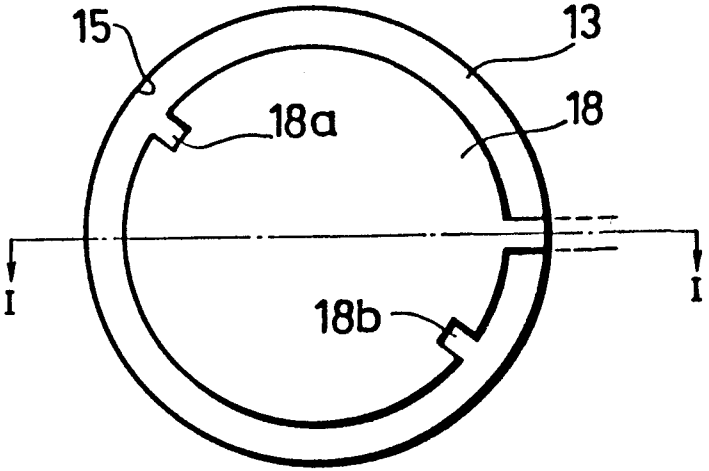
FIG. 3A is a top view of a main portion of an embodiment of a circular patch-slot array antenna according to the present invention.
Figure 3B:
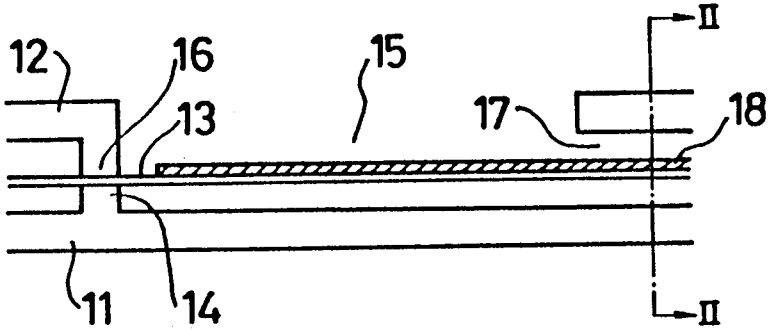
FIG. 3B is a cross-sectional view taken through the line I—I in FIG. 3A.

FIGS. 3A and 3B illustrate an arrangement of a circular polarized radiation element according to the present invention. FIG. 3A is a top view thereof and FIG. 3B is a cross-sectional view taken through the line I—I in FIG. 3A. Throughout FIGS. 3A and 3B, reference numeral 11 designates a first metal plate (or metallized plastic plate), 12 a second metal plate (or metallized plastic plate) and 13 a substrate made of a thin film (film-shaped flexible insulating substrate) sandwiched between the first and second metal plates 11 and 12. The first metal plate 11 has a convex-shaped supporting portion 14 for supporting the substrate 13 thereon. The second metal plate 12 has an opening of, for example, 14 mm in diameter, i.e., a slot 15 and a convex-shaped supporting portion 16 formed around the slot 15 for supporting the substrate 13 in cooperation with the supporting portion 14. When the first and second metal plates 11 and 12 sandwich the substrate 13 therebetween, the plates 11 and 12 are positioned such that their supporting portions 14 and 16 are made consistent with each other. At that time, the thickness of each of the first and second metal plates 11 and 12 is reduced very much and it becomes, for example, only about 2 mm. Further, when the substrate 13 is sandwiched between the first and second metal plates 11 and 12, there is formed a cavity portion 17 which communicates with the slot 15.

A conductive foil 18 is deposited on the substrate 13 so as to correspond to and be concentric with the slot 15 of the second metal plate 12 and to form resonance type printed patch radiator. This conductive foil 18 is coupled through the cavity portion 17 to a suspended line. In this case, the conductive foil 18 of a substantially circular-shape is arranged to have a diameter so as to resonate at a predetermined frequency. The conductive foil 18 is provided with slits **18*a* and 18*b* diametrically opposed to each other at positions related to the suspended line by a predetermined angle, for example, 45° in order to receive and transmit a circular polarized wave. In this embodiment, when transmitting or receiving microwaves on the surface of the sheet of the drawing, the antenna of the invention can transmit or receive a clockwise circular polarized wave. To transmit or receive a counter-clockwise circular polarized wave, the slits 18*a* and 18*b* have to be formed on the conductive foil 18** at 45° relative to the suspended line on the opposite side to those for the clockwise circular polarized wave.

Figure 4:
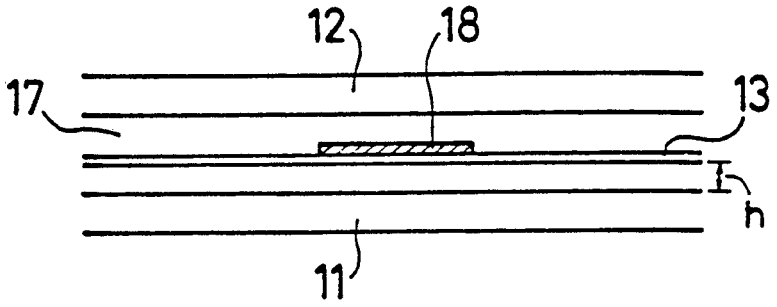
FIG. 4 is a cross-sectional view taken through the line II—II in FIG. 3B.

The structure of the suspended line for feeding the planar array is illustrated in FIG. 4 which is a cross-sectional view taken through the line II—II in FIG. 3B. In this embodiment, the conductive foil 18 formed by etching a conductive film coated on the substrate 13 of, for example 25 to 100 μm thick, surrounded by the first and second metal plates 11 and 12 to form a cavity-shaped coaxial line. In this case, since the substrate 13 is thin and acts only as the supporting member, it forms a feeding line which is not the low loss substrate but it has small transmission loss. While the transmission loss of the open strip line made of, for example, Teflon (registered trademark) glass substrate falls in a range of 4 to 6 dB/m at 12 GHz, in the case of the suspended line made of a film-shaped substrate of 25 μm thick, its transmission loss falls in a range of about 2.5 to 3 dB/m at 12 GHz. Since the film-shaped flexible substrate is inexpensive as compared with the substrate made of Teflon glass, this film-shaped flexible substrate can bring about many advantages also.

Figure 5:
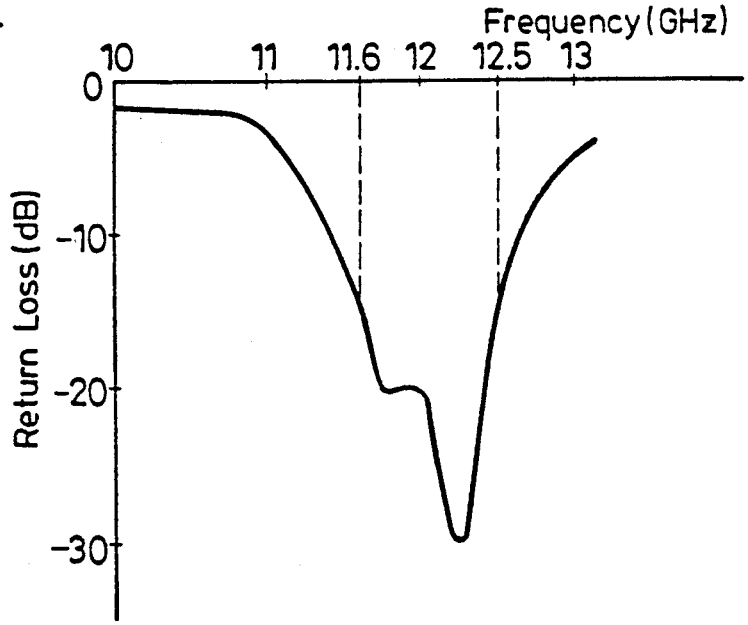
FIGS. 5 and 6 are respectively graphs showing a characteristic of a circular polarized wave radiation device of the present invention.

FIG. 5 illustrates a characteristic of the circular polarized radiation element of the present invention. From FIG. 5, it is thus apparent that this circular polarized radiation element of the invention has an excellent return loss of −30 dB and that the single element has a return loss of −14 dB (voltage standing wave ratio (VSWR)<1.5) with a bandwidth of about 900 MHz, thus a relatively wide gain being brought about. The reason for this is that while the height h from the top surface of the first metal plate 11 to the top surface of the substrate 13 is about 1 mm, the equivalent relative dielectric constant $\epsilon_r$ is formed of air between the first metal plate 11, and the substrate 13 and relative dielectric constant of the substrate 13 can be selected to be as small as about 1.05.

Figure 6:
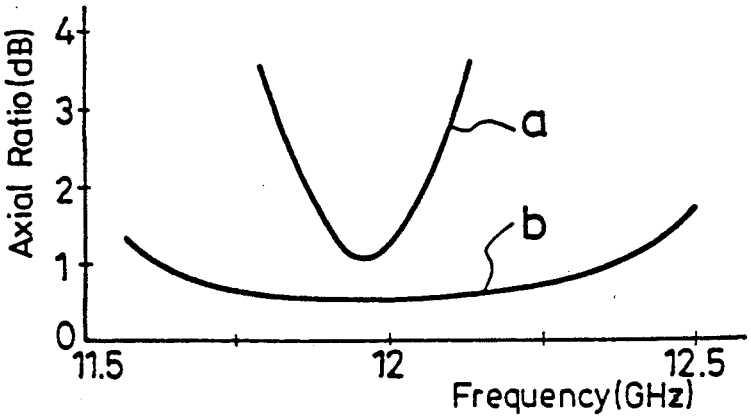

FIG. 6 shows a characteristic graph illustrating an example of the measured axial ratio of the circular polarized wave in the present invention. In FIG. 6, a curve a indicates a measured axial ratio where the antenna of the invention has a single circular polarized radiation element, and a curve b indicates a measured axial ratio where the antenna of the invention has four circular polarized radiation elements. For example, while a tolerance range is about 1 dB at frequency of 12 GHz, the circular patch-slot planar array antenna of the present invention sufficiently satisfies this tolerance range.

Figure 7:
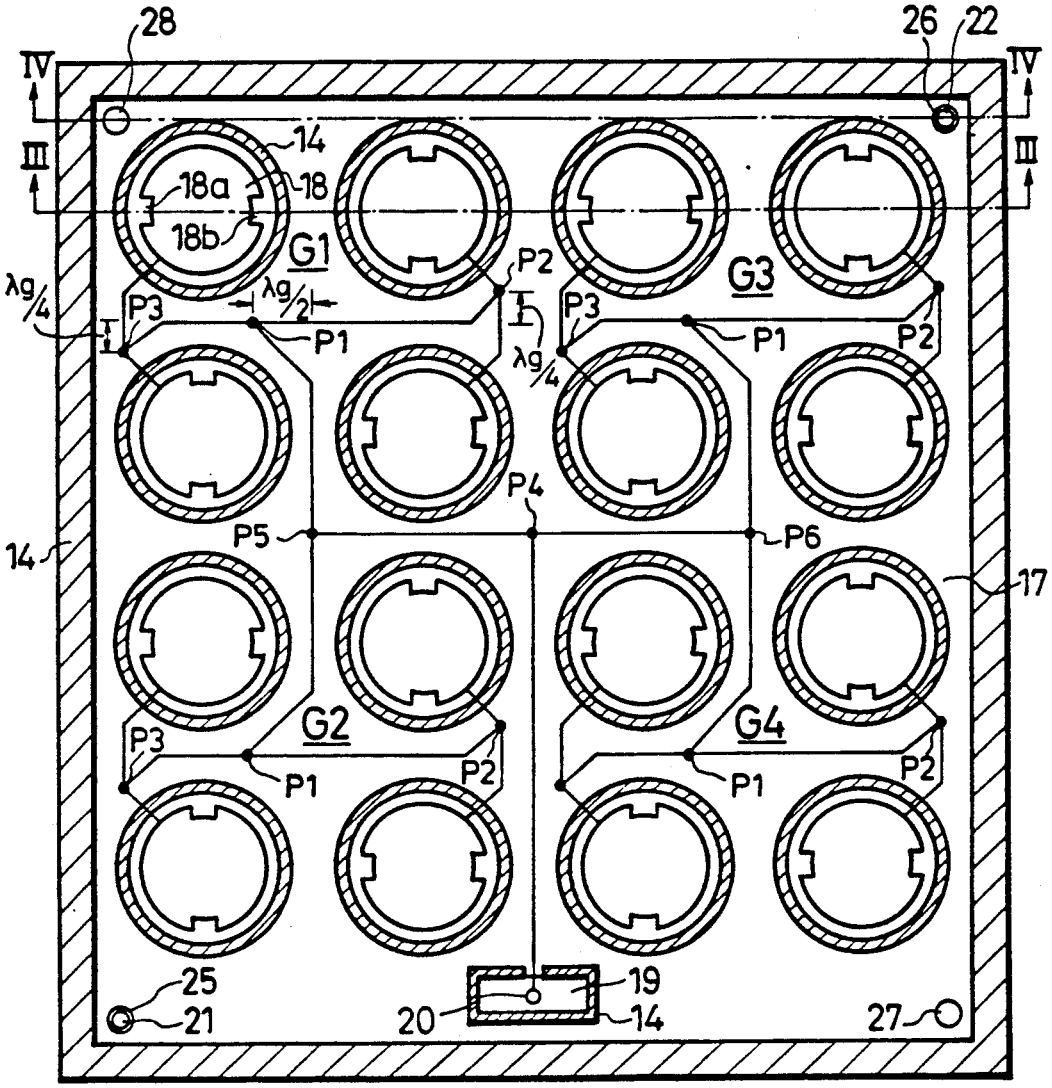
FIG. 7 is an illustration used to explain the feeding method of the antenna of the present invention.

FIG. 7 illustrates a circuit arrangement of a co-phase feeding circuit in which a plurality of circular polarized radiation elements shown in FIGS. 3A and 3B are provided and the suspended line is used to effect the co-phase feeding, thus forming a planar array antenna. In addition, as shown in FIG. 7, a plurality of circular patches are respectively provided in response to a plurality of slots, thus forming a circular patch-slot array antenna on the whole.

Figure 8:
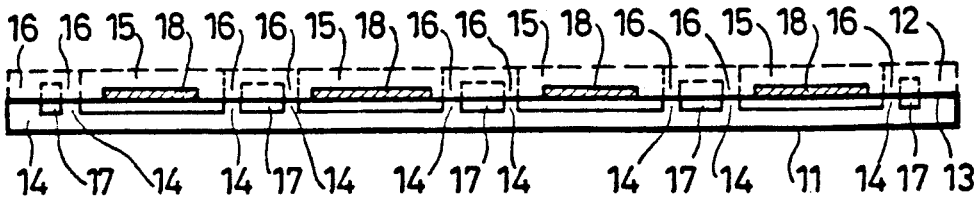
FIG. 8 is a cross-sectional view taken through the line III—III in FIG. 7.

The solid-line portion in FIG. 8 illustrates a portion cut through the line III—III in FIG. 7. The broken-line portion of FIG. 8 illustrates such a condition that the second metal plate 12 covers the top of the arrangement shown in FIG. 7.

As FIGS. 7 and 8 show, a supporting portion 14 is formed on the first metal plate 11, around the periphery of each of the slots 15 bored through the second metal plate 12, in order to support the substrate 13. The supporting portion 14 is also formed around a feeding portion 19 passing through the first metal plate 11 to support the substrate 13. The supporting portion 14 is further provided around the outer peripheral portion of the planar array antenna. Other portions thereof form the cavity portions 17. Therefore, there is a risk that the outputs from the plurality of conductive foils 18 may be delivered through the same cavity portion 17 and hence the above-mentioned outputs will be coupled with each other. If however, the spacing between the adjacent conductive foils 18 and the spacing between the upper and lower walls of the cavity portions 17 are properly selected, necessary isolation can be established, thus removing the above-mentioned risk of mutual coupling. At that time, since electric lines of force are concentrated on the upper and lower walls of each cavity portion 17, electric field along the substrate 13 supporting the conductive foils 18 is substantially reduced, thus lowering the dielectric loss. As a result, the transmission loss of the line can be reduced.

The supporting portion and the cavity portion are also formed on the second metal plate 12 in correspondence with the first metal plate 11. Specifically, the supporting portion 16 are formed around the slots 15 bored through the second metal plate 12, around the periphery of the feeding portions (the top wall thereof is closed) and around the outer periphery of the planar array portion, while other portions form the cavity portions 17 (see FIG. 8).

Since the substrate 13 is uniformly supported by the supporting portions 14 and 16, provided as described above, it can be prevented from being warped downwardly. In addition, since the top and bottom metal plates 11 and 12 are brought in closed contact with the substrate 13 around the respective radiation elements, the feeding portions and so on similarly to the prior art, it is possible to prevent any resonance at a particular frequency and so on from being caused.

Referring to FIG. 7, 16 radiation elements are collected by four to provide 4 radiation element groups G1 to G4. A junction P1 of each group is displaced from the center by a length of $\lambda_g/2$ ($\lambda_g$ represents the line wavelength at the center frequency). Junctions P2 and P3 between two radiation elements in each group are connected with a displacement of each of $\lambda_g/4$ from the center. Accordingly, in each group of the radiation elements, the lower-right-hand radiation element is displaced from the upper-right-hand radiation element by 90°, the lower-left-hand radiation element is displaced therefrom by 180° and the upper-left-hand radiation element is displaced therefrom by 270° in phase, respectively, thus the axial ratio is improved. In other words, the axial ratio can be improved to be wide by varying the spatial phase and the phase of the feeding line. In view of another aspect, any two of vertically or horizontally neighboring patch radios have slit directions 90° apart from each other.

The junction P1 (FIG. 7) and the junctions P4 to P6 of the respective groups are coupled to one another in such a fashion that they are separated from the feeding point 20 of the feeding portion 19 by the same distance. With the above-mentioned arrangement, it is possible to obtain various kinds of directivity characteristics by changing the feeding phase and the power distribution ratio by changing the positions of the junction P1 and the junctions P4 to P6. In other words, the feeding phase is changed by varying the distance from the feeding point 20 to the junction P1 and the junctions P4 to P6 or the amplitude is varied by varying the impedance ratio by increasing or decreasing the thickness of the lines at which the suspended line is branched, whereby the directivity characteristics can be varied in a wide variety.

According to the embodiment of the present invention, as set forth above, since the thickness of the radiation element (substantially the sum of the thicknesses of the first and second metal plates 11 and 12) becomes only about 4 mm, the antenna made of metal weighs about 1.1 kg (a square of 40 cm×40 cm) or the antenna made of metallized plastic material weighs 0.3 to 0.5 kg (a square of 40 cm×40 cm), thus the antenna of the present invention being reduced both in weight and thickness. Further, since the antenna of the present invention is very thin, the antenna made of metal can be manufactured by a press technique and can be mass-produced efficiently. Being light-weight and reduced in thickness, the antenna of the invention can be manufactured at low cost and can be made attractive as a product from a marketability standpoint. Since the equivalent relative dielectric constant $\epsilon_r$ of the invention can be reduced to 1.05, high antenna gain and wide band width can be presented.

Furthermore, since the suspended line is employed as a feeding line, the opening 15 formed through the second metal plate 12 is formed as a slot and the diameter of this slot 15 is selected to be as small as about 14 mm, and the isolation between the radiation elements can be made sufficiently high so that the width of the feeding line can be increased, and the transmission loss can be reduced. In addition, since the antenna gain and wide bandwidth can be obtained and the transmission loss can be lowered, the gain (efficiency) of the antenna can be improved.

While the radiation element is mainly described in the aforesaid embodiment, it is needless to say that owing to reciprocity theorem of the antenna, the radiation element (or antenna formed of radiation element array) can act as a receiving element (reception antenna) without changing the characteristics thereof.

While the circular resonance type printed patch radiator is described in the above-mentioned embodiment, the shape of the resonance type printed patch radiator is not limited to circular but it can take other desired shapes.

While the antenna of this embodiment is used for the frequency band of 12 GHz, it can be similarly applied to other frequency bands by varying the dimensions of the radiation element.

According to the embodiment of the present invention, as described above, since the resonance type printed patch radiator element is provided on the substrate at the position corresponding to the slot formed on one of the pair of metal or metallized plastic plates, the antenna of the present invention can be reduced both in weight and thickness. Also, the cost thereof can be reduced, the efficient mass-production can be made and the antenna of the invention can be made attractive from a marketability standpoint. Furthermore, since high gain with a wide bandwidth can be presented and the transmission loss at the feeding line can be reduced, it is possible to increase the gain (efficiency) of the antenna.

The features of the present invention will now be described more fully, high-lighting its structure.

Figure 9:
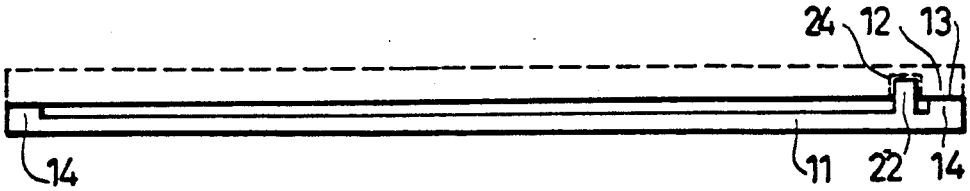
FIG. 9 is a cross-sectional view taken through the line Iv—Iv in FIG. 7.

Turning back to FIG. 7, a pair of positioning pins 21 and 22 are provided on the first metal plate 11 at its predetermined positions, for example, on its diagonal. In association therewith, a pair of slots 23 (not shown) and 24 (see FIG. 9) are formed through the second metal plate 12. On the substrate 13, there are provided a pair of openings 25 and 26 in association with the pair of positioning pins 21 and 22. Further, through the substrate 13, there are provided a pair of openings 27 and 28 in response to the pair of pins 21 and 22 when the substrate 13 is turned over for the case where the antenna is made useful for the counter-clockwise circular polarized wave.

Upon assembly, the substrate 13 is placed in such a fashion that the positioning pins 21 and 22 of the first metal plate 11 are engaged with the slots 25 and 26 of the substrate 13, respectively. Then, on the substrate 13, there is placed the second metal plate 12 in such a manner that the positioning pins 21 and 22 of the first metal plate 11 are engaged with the openings 23 and 24 of the second metal plate 12, respectively, thus forming a circular patch-slot array antenna for use in the clockwise circular polarized wave.

Figure 10:
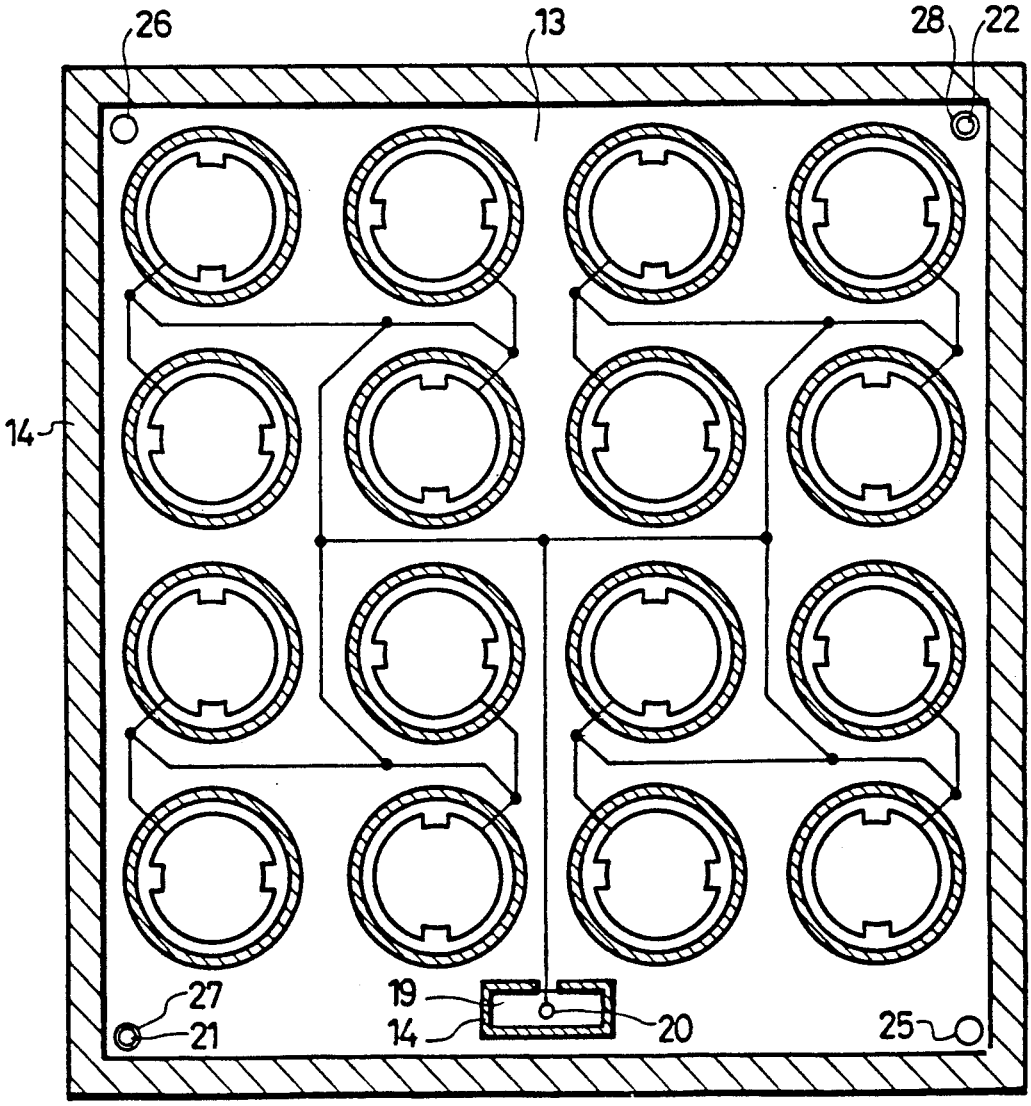
FIG. 10 is an illustration of another example of the method for feeding the antenna of the present invention.

When a circular patch-slot array antenna for the counterclockwise circular polarized wave is constructed, the second metal plate 12 is removed from the circular patch-slot array antenna for the clockwise circular polarized wave and the substrate 13 is turned over as illustrated in FIG. 10. This time, the positioning pins 21 and 22 of the first metal plate 11 are engaged with the openings 27 and 28 of the substrate 13. Then, the second metal plate 12 is put on the first metal plate 11 through the substrate 13. It is needless to say that at that time, the positioning pins 21 and 22 of the first metal plate 11 are respectively engaged with the openings 23 and 24 of the second metal plate 12, similarly to the circular patch-slot array antenna for the clockwise circular polarized wave, thus forming the circular patch-slot array antenna for the counter-clockwise circular polarized wave.

Since the substrate 13 is very thin (for example, 25 to 50 μm), the substrate 13 can be turned over without causing any problem from a characteristic standpoint.

According to this embodiment, as described above, the circular patch-slot array antennas for clockwise and counter-clockwise circular polarized waves can be constructed respectively by merely turning over the substrate 13. Thus, the assembly parts of the above-mentioned clockwise and counter-clockwise circular patch-slot array antennas can be made in common and used commonly, so that the manufacturing cost thereof can be reduced.

While the pair of positioning pins are provided on the first metal plate and the corresponding pair of openings are provided on the second metal plate in the above-mentioned embodiment, it is also possible that positioning pins and openings are provided on the first metal plate and corresponding openings and positioning pins are provided on the second metal plate in association therewith.

Further, while the pair of positioning pins are provided on the diagonal, the positions of the pins are not limited to the diagonal but the pins may be provided at desired positions, for example, the positions slightly displaced from the diagonal with each other, or the pins may be provided on a straight line. Furthermore, the number of positioning pins is not limited to the pair but may be increased.

Figure 11A:
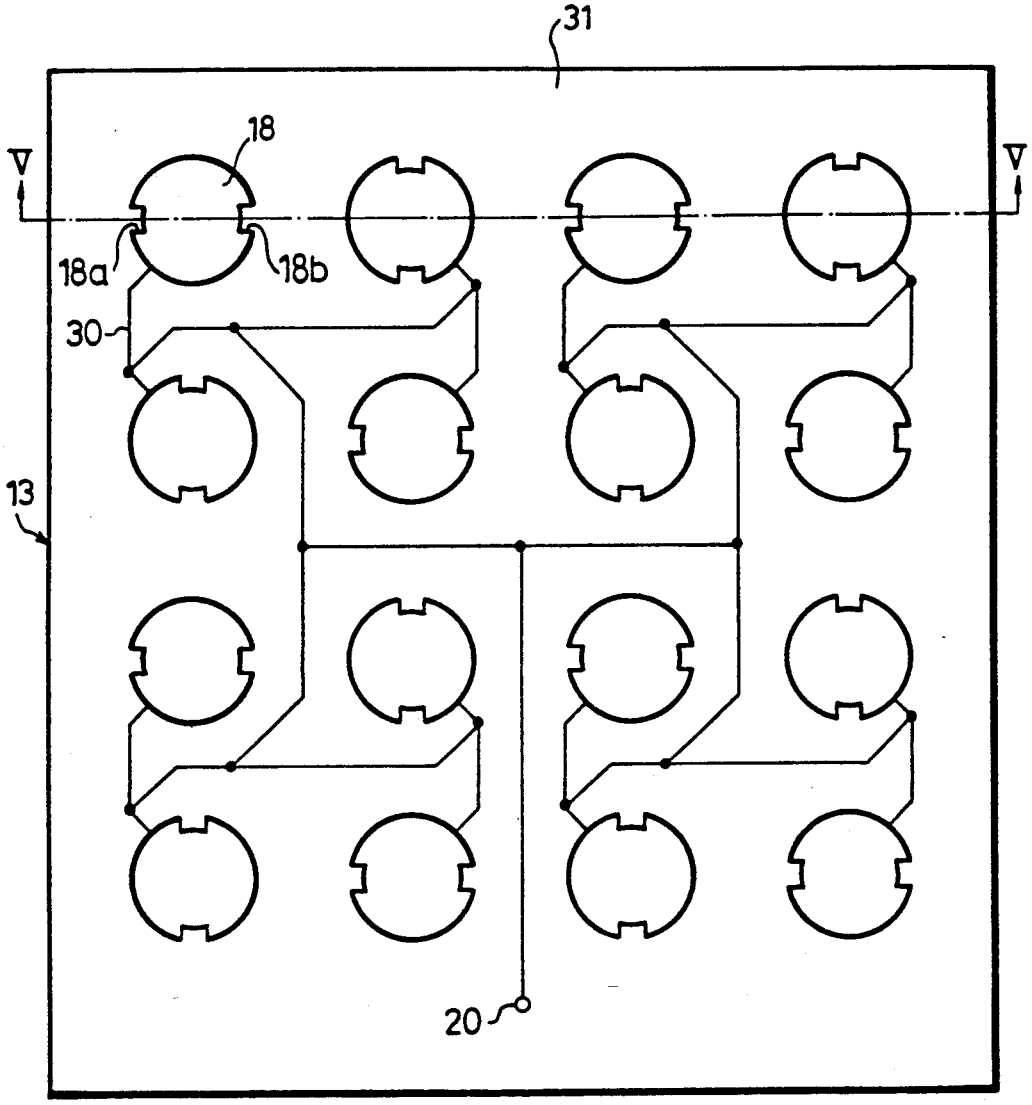
FIG. 11A is an illustration of an example of a flexible substrate that can be used in the antenna of the present invention.
Figure 11B:
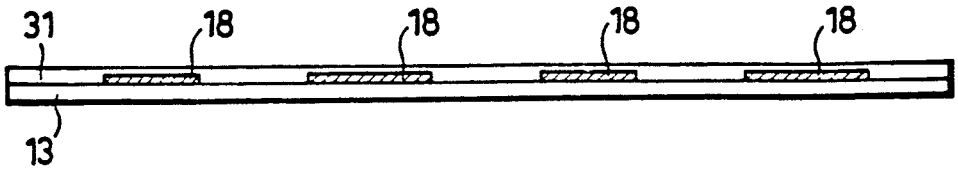
FIG. 11B is a cross-sectional view taken through the line V—V in FIG. 11A.

FIGS. 11A and 11B illustrate a more improved printed substrate 13. FIG. 11A is a plan view thereof and FIG. 11B is a cross-sectional view taken through the line V—V in FIG. 11A.

Referring to FIGS. 11A and 11B, there is provided a substrate 13 which is made of a flexible thin film having a thickness of, for example, about 25 to 100 μm. On this substrate 13, there are provided printed resonance type printed patch radiator elements 18 concentric with a number of slots 15 formed through the second metal plate 12. These resonance type printed patch radiator elements 18 are connected to one another through conductive foils 30 deposited on the substrate 13 and forming the suspended line. The conductive foils 30 are deposited on the substrate 13 similarly to the resonance type printed patch radiator elements 18.

According to this embodiment, a protective film 31 is provided on the substrate 13 so as to protect at least the resonance type printed patch radiator elements 18 and the conductive foils 30. This protective film 31 is a thin film made of, for example, polyester or epoxy-group resin. The thickness of the protective film 31 has to be thin because if the thickness of the protective film 31 is more than, for example, 10 μm, the loss on the electrical characteristic is increased so that the gain of the antenna is degraded. From the experimental results, it was thus proved that if the thickness of the protective film 31 is less than, for example, 1 μm, the influence falls within a tolerance range regardless of the material that forms the protective film 31. In this connection, according to the measured results, it was also confirmed that the transmission loss of the suspended line per, for example, 25 cm, is increased by only about 0.05 dB when the thickness of the protective film 31 is less than 1 μm. This does not cause any problem in practice.

According to the embodiment of the present invention, as set forth above, it is possible to obtain the circular patch-slot array antenna having water-repellent property and anti-corrosion property without deteriorating the electrical characteristic. Further, since the flexible substrate 13 is covered with only the protective film 31, the structure of the antenna according to this embodiment can be very simple and the manufacturing cost thereof is not increased so much.

According to the antenna structure shown in FIGS. 11A and 11B, since the protective film is provided on the flexible substrate, the water-repellent property and the anti-corrosion property can be assured. In addition, the array antenna of the embodiment can be manufactured at low cost and the arrangement thereof can be simple.

FIGS. 12 to 16 respectively illustrate various examples of modifications by which the printed substrate 13 is fixed between the first or bottom plate 11 and the second or top plate 12.

Figure 12:
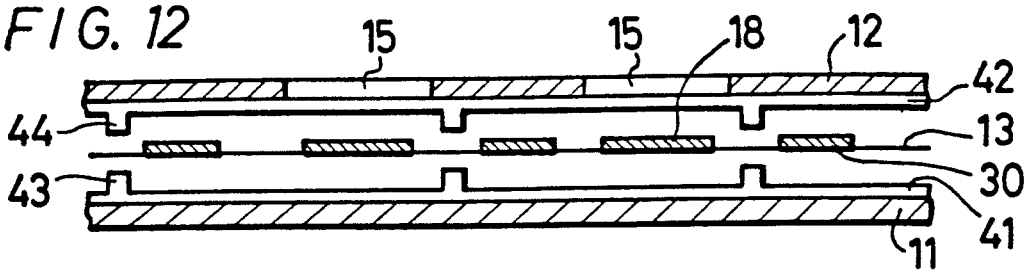
FIGS. 12, 13, 14 and 16 are respectively cross-sectional views used to explain the examples of the mounting structures of the substrates in the circular patch-slot array antenna of the present invention.

Referring to FIG. 12, a supporting member 41 is provided between the bottom plate 11 and the substrate 13, and a supporting member 42 is provided between the top plate 12 and the substrate 13. Each of the supporting members 41 and 42 is made of dielectric material such as a highly foamed plastic material having a low dielectric constant. On these supporting members 41 and 42, there are integrally formed protrusions 43 and 44 in opposing relation to each other at the positions where they cannot hinder the radiation element 18 and the feeding line 30. The substrate 13 is supported by these protrusions 43 and 44.

In FIG. 12, the shape of each of the protrusions 43 and 44 is not limited to the protruded one but can be changed freely so long as it cannot hinder the radiation element 18 and the feeding line 30. For example, each of the protrusions 43 and 44 may be formed as substantially as a circle which surrounds the radiation element 18.

Since in the embodiment of FIG. 12 the substrate 13 is supported by the protrusions 43 and 44 of the supporting members 41 and 42, each of the bottom plate 11 and the top plate 12 can be formed by a flat plate, thus simplifying the arrangement of this embodiment more than those of the embodiments shown in FIGS. 7 and 10. Further, since the cutting work or the like is not necessary, the antenna of this embodiment can be manufactured with ease, allowing highly-efficient mass production. In addition, the manufacturing cost thereof can be reduced. Furthermore, the shape of each of the protrusions 43 and 44 can be modified freely, thereby to increase the accuracy at which the substrate 13 is supported by these protrusions 43 and 44.

Figure 13:
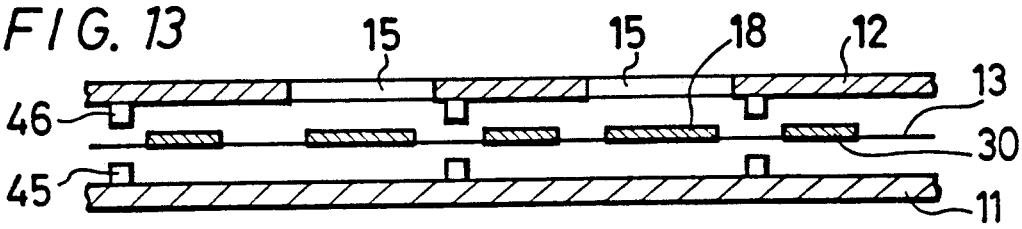

In the embodiment shown in FIG. 13, protrusions 45 and 46 are respectively formed on the bottom plate 11 and the top plate 12 in opposing relation at the positions where they cannot hinder the radiation element 18 and the feeding line 30. Each of the protrusions 45 and 46 is made of, for example, metal or dielectric material, and the substrate 13 is supported by these protrusions 45 and 46.

Figure 14:
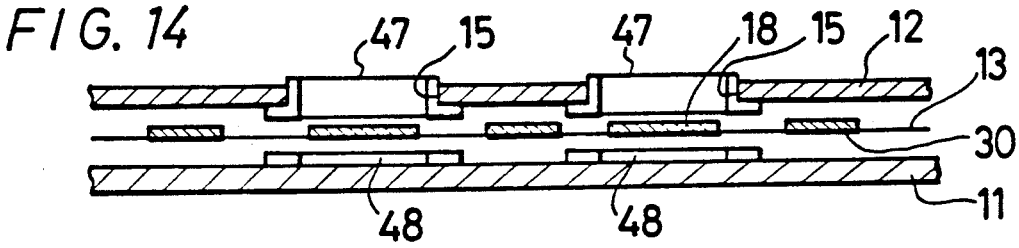
Figure 15:
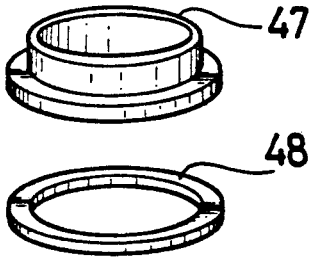
FIG. 15 is a perspective view illustrating a main portion of FIG. 14.

Since in the embodiment shown in FIG. 13 the substrate 13 is supported by the protrusions 45 and 46 as described above, each of the bottom plate 11 and the top plate 12 can be formed by a single flat plate. Thus, the arrangement can be simplified more and the cutting work or the like is not necessary, with the result that the patch-slot array antenna of this embodiment can be manufactured with ease, thus resulting in a more efficient mass production. In addition, the circular patch-slot array antenna of this embodiment can be manufactured at low cost FIG. 14 illustrates another modified example of the circular patch-slot array antenna of the invention in which the above-mentioned protrusions are replaced with a flange 47 and a ring 48. Specifically, the flange 47 of the shape shown, for example, in FIG. 15 is engaged into each of the slots 15 of the top plate 12 shown in FIG. 14 and the ring 48 of the shape as, for example, shown in FIG. 15 is provided on the bottom plate 11 in an opposing relation to the flange 47, thus the substrate 13 being supported by the flange 47 and the ring 48.

The total number of the flanges 47 and the rings 48 may be selected freely so long as the substrate 13 can be stably supported as a whole. Each of the flanges 47 and the rings 48 may be made of, for example, metal or plastic material. When the flange 47 is made of metal, it is enough that the inner diameter of the slot 15 is increased by the amount corresponding to the thickness of the flange 47.

Since in the embodiment shown in FIG. 14 the combination of the flange 47 and the ring 48 is employed as the protrusions to support the substrate 13 therebetween, each of the bottom plate 11 and the top plate 12 may be formed by a single flat plate so that the arrangement can be simplified and that cutting work or the like can be omitted, thus making it possible to manufacture the circular patch-slot array antenna of this embodiment with ease. Also, this allows more efficient mass production and the manufacture the circular patch-slot array antenna of the invention can be at low cost. Furthermore, since the substrate 13 is supported by the flange 47 and the ring 48 of substantially annular-shape, the substrate 13 can be supported with higher accuracy.

Figure 16:
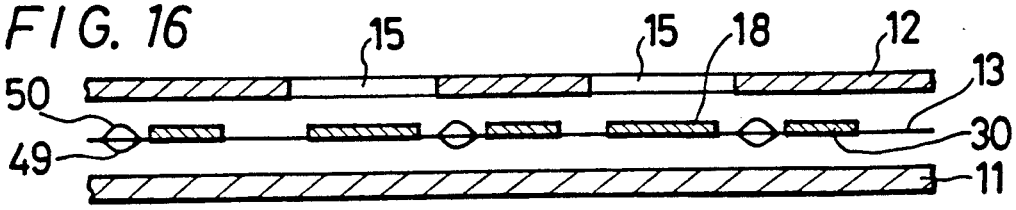

FIG. 16 illustrates a further modified example of the circular patch-slot array antenna of this invention. In this embodiment shown in FIG. 16, on the back and front surfaces of the substrate 13, there are provided protrusions 49 and 50 produced by, for example, depositing resin or printing of resin at the positions where they may not disturb the radiation elements 18 and the feeding lines 30. Then, the protrusion 49 is brought into contact with the bottom plate 11 and the protrusion 50 is brought into contact with the top plate 12, so that the substrate 13 is supported thereby.

Since in the embodiment shown in FIG. 16 the substrate 13 is substantially supported by the protrusions 49 and 50, also in accordance with this embodiment, each of the bottom plate 11 and the top plate 12 can be formed by the single flat plate, thus simplifying more the arrangement of the circular patch-slot array antenna. Further, since the cutting work or the like becomes unnecessary, the mass production of the circular patch-slot array antenna can be made more efficient and the circular patch slot array antenna of the invention can be manufactured at a low cost. Furthermore, since the substrate 13 is supported only by the protrusions 49 and 50 formed thereon, it becomes possible to realize the circular patch-slot array antenna of which the whole thickness can be reduced.

Figure 17:
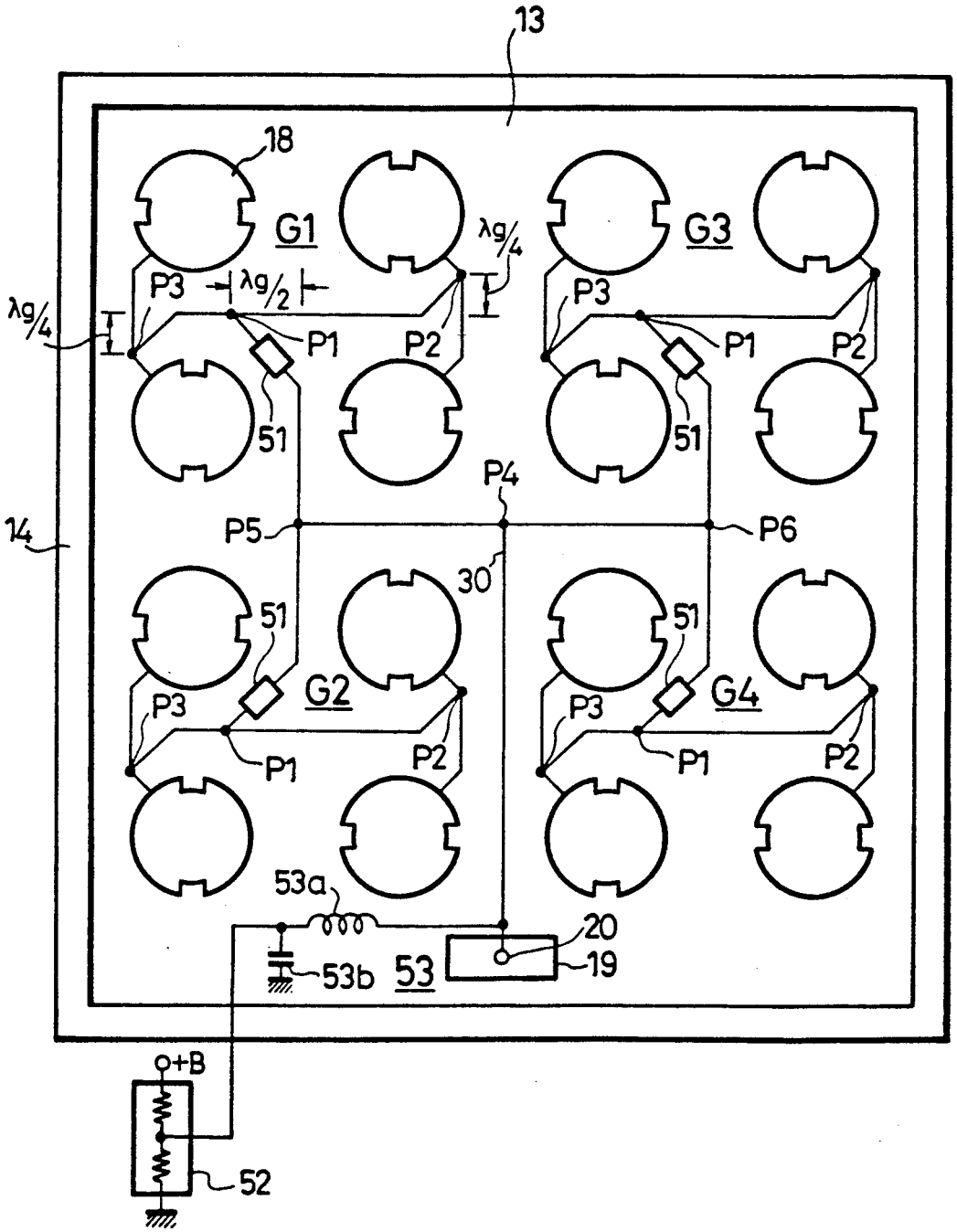
FIG. 17 is a schematic representation showing an example of a feeding method by which the gain of the antenna of the present invention is improved.

FIG. 17 illustrates a further example of a modified circular patch-slot array antenna of the present invention wherein the antenna gain is increased by the use of active elements.

In the embodiment shown in FIG. 17, an active circuit 51 is provided at the positions nearest the radiation element 18 of each of the groups G1 to G4 on the substrate 13, for example, near each of the junctions P1. Outside of the antenna proper, a bias circuit 52 is provided to supply a bias voltage (DC voltage) to the active circuit 51. The bias circuit 52 is connected near the feeding point 20 of the feeding portion 19 through a signal blocking circuit 53 formed of, for example, a coil 53*a* and a capacitor 53*b*. The signal blocking circuit 53 serves to prevent a signal component flowing from the feeding point 20 to the bias circuit 52. The coil 53*a* and the capacitor 53*b* of the signal blocking circuit 53 may be formed on the substrate 13 in a printed circuit pattern fashion. The bias voltage from the bias circuit 52 is supplied to the signal blocking circuit 53 and is then supplied through the suspended line (feeding line) 30 which leads from the feeding portion 19 to each of the active circuits 51.

Figure 18:
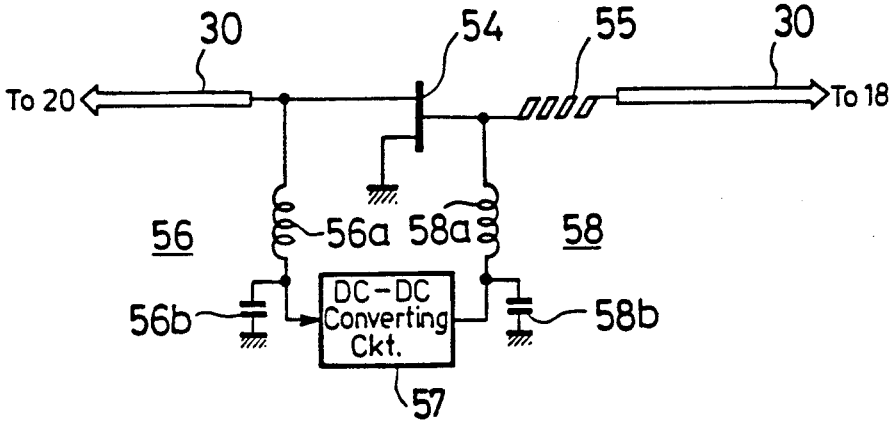
FIG. 18 is a block diagram showing a circuit arrangement of the main portion of FIG. 17.

The active circuit 51 is formed of, for example, a circuit that FIG. 18 illustrates. Referring to FIG. 18, an active element 54 with a low noise component is provided which is formed of, for example, GaAs MES FET (metal semiconductor field effect transistor) or GaAs HEMT (high electron mobility transistor) or the like. The first main electrode thereof is connected through the suspended line 30 to the feeding point 20 and the second main electrode thereof is grounded. Further, the control electrode thereof is connected to each of the radiation elements 18 through a so-called parallel-coupled-type band-pass filter 55 made of a conductive foil and the suspended line 30. The band-pass filter 55 is provided to prevent the signal from being disturbed by the UHF (ultra high frequency) or VHF (very high frequency) band because when the active element is used, the signal is easily disturbed thereby. As the band-pass filter 55, it is possible to use a so-called end-coupled type filter, and the details thereof are disclosed in the above-mentioned U.S. patent application Ser. No. 58,286.

Further, between the first main electrode and the control electrode of the active element 54, there are provided a signal blocking circuit 56, a DC-DC converting circuit 57 serving as a bias circuit and a signal blocking circuit 58. The signal blocking circuits 56 and 58 are respectively formed of a coil 56*a* and a capacitor 56*b*, and a coil 58*a* and a capacitor 58*b* to prevent the signal component from being fed to the DC—DC converting circuit 57 similar to the signal blocking circuit 53. All of them can be formed on the substrate 13 as printed patterns. The DC—DC converting circuit 57 converts the positive bias voltage from the bias circuit 52 to a negative bias voltage and supplies this negative bias voltage to the control electrode of the active element 54. Of the active element 54, the first main electrode is supplied with the positive bias voltage relative to the ground potential of the second main electrode, and the control electrode is supplied with the negative bias voltage relative to the ground potential of the second main electrode. Accordingly, a stabilized positive bias voltage, for example, 15 V from the bias circuit 52, is directly supplied to the first main electrode of the active element 54 and also it is converted to the negative bias voltage, for example −1 V, by the DC—DC converting circuit 57 and then fed to the control electrode of the active element 54.

The signal from each of the radiation elements 18 is amplified by the active element 54 and is then supplied through the suspended line 30 to the feeding point 20. At that time, since the signal is sufficiently amplified by the active element 54, heat noise or the like generated in the midway suspended line 30 can be neglected substantially so that a satisfactory S/N ratio can be obtained at the feeding point 20. If the antenna gain at the feeding point 20 is amplified beforehand by the active element 54, considering that the antenna gain will be lost in the suspended line 30, a desired antenna gain can always be obtained at the feeding point 20.

Further, since the bias voltage from the bias circuit 52 is substantially supplied through the suspended line 30 to the active elements 54 of the respective active circuits 51, a special bias pattern does not have to be formed on the substrate 13, simplifying the printed pattern.

Figure 19A:
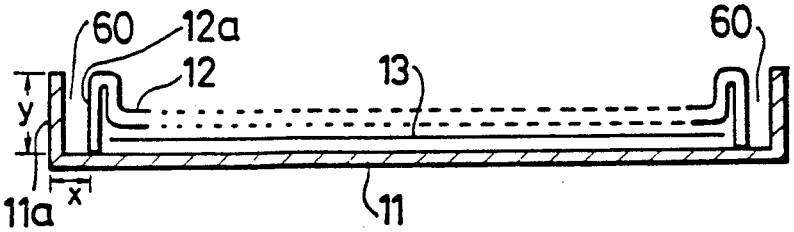
FIGS. 19A and 19B are illustrations showing examples of the structures of the improved peripheral portions of the antenna of the present invention.
Figure 19B:
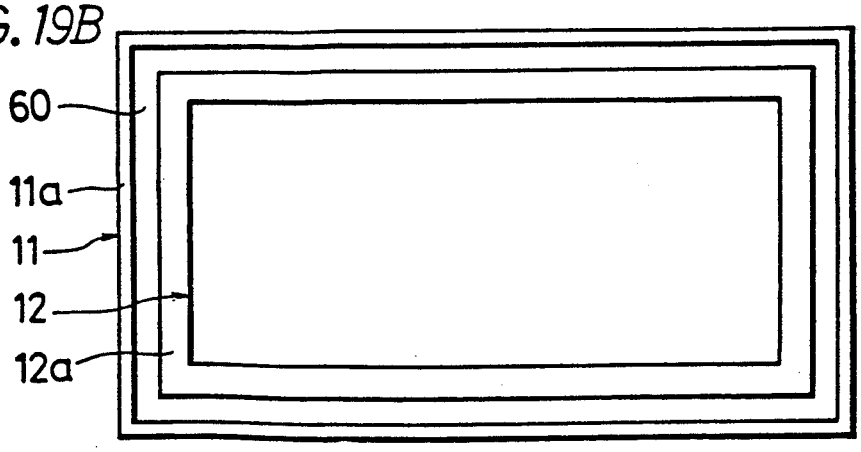

FIGS. 19A and 19B, forming a side view and a plan view, illustrate yet a further example of a modified circular patch-slot array antenna of the present invention in which between the peripheral edge portions of the first or bottom plate 11 and the second or top plate 12 there is provided a U-shaped groove to trap an undesired signal.

As shown in FIGS. 19A and 19B, the peripheral edge portion 11*a* of the bottom plate 11 is curved upwards to form an L-shaped peripheral edge portion and the peripheral edge portion 12*a* of the top plate 12 is curved to form an ohm-shaped peripheral edge portion, thus a U-shaped groove 60 is formed therebetween. Depth y of the groove 60 is selected to be, for example, 6 mm (corresponding to ¼ wavelength of 12 GHz) and the width x is selected to be, for example 2 mm. By way of example, the thickness of each of the top and bottom plates 12 and 11 is 1 mm and the spacing between the top and bottom plates 12 an 11 is 2 mm.

Figure 20:
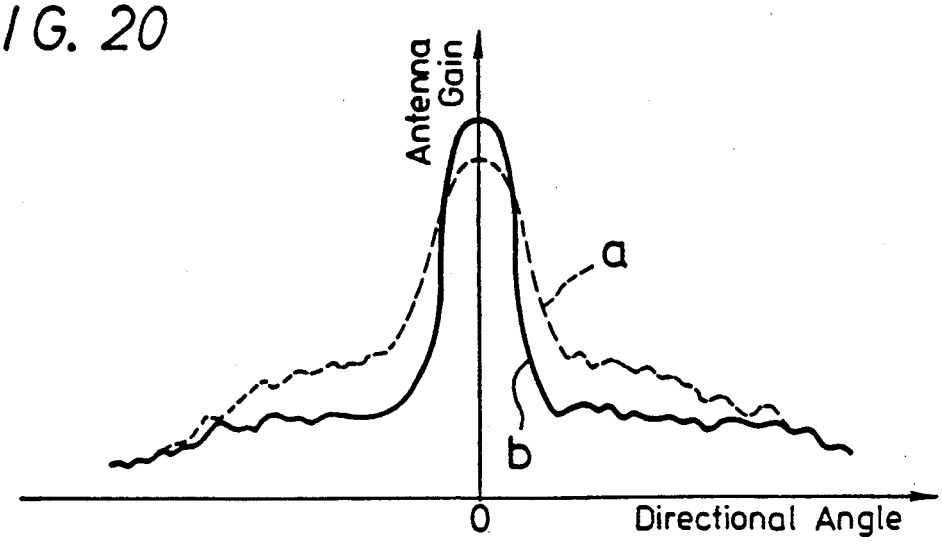
FIG. 20 is a graph showing antenna characteristics of the antenna of the invention shown in FIGS. 19A and 19B.

Since the U-shaped groove 60 is formed between the peripheral edge portions of the top and bottom plates 12 and 11 as described above, impedance for a signal current flowing through such U-shaped groove 60 is increased, thus blocking current (undesired signal) flowing from the top plate 12 to the bottom plate 11 or from the bottom plate 11 to the top plate 12. That is, the undesired signal can substantially be trapped by the groove 60. Accordingly, an antenna gain characteristic is achieved, as shown by a solid line b in the characteristic graph FIG. 20. From FIG. 20, it is thus apparent that the side lobe level of the antenna is lowered as compared with a characteristic (shown by a broken line s) presented when the U-shaped groove is not provided, thus the gain of the main beam is increased. Since the side lobe characteristic of the antenna is improved as described above, a disturbing wave near the side lobe can be suppressed and hence, the disturbing wave removing characteristic of the antenna can be improved. Furthermore, since the gain of main beam is increased, the antenna gain can also be increased.

Figure 21:
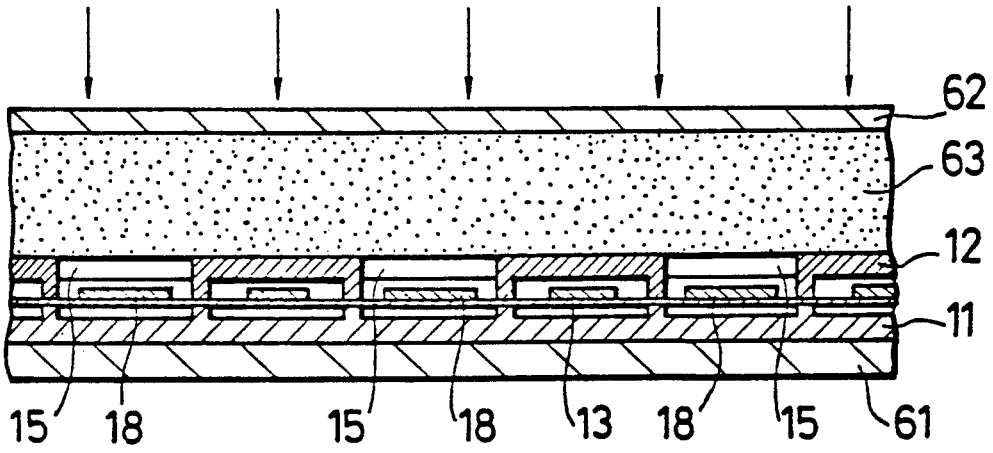
FIGS. 21 and 22 are cross-sectional views illustrating overall arrangements of the antennas of the present invention, respectively.
Figure 22:
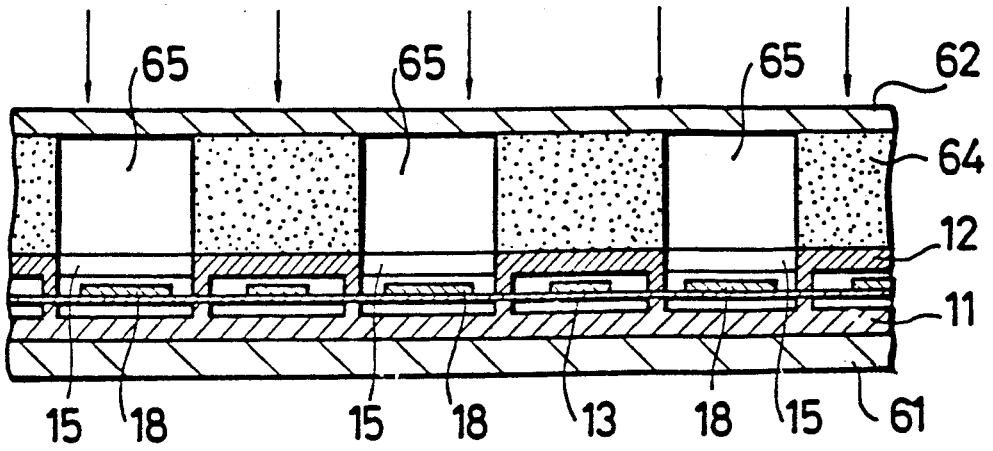

FIGS. 21 and 22, forming cross-sectional views, illustrate in cross section practical examples of the whole arrangements of the circular patch-slot array antennas of the present invention.

As FIG. 21 shows, the above-mentioned first or bottom plate 11 is provided on a rear cover 61, and the film-shaped substrate 13 is located on the bottom plate 11. The top plate 12 is provided thereon. The top plate 12, the film-shaped substrate 13 and the bottom plate 11 are secured to the rear cover 61 by suitable fixing means such as screws and so on, though not shown. A heat insulating plate 73 is made of, for example, a highly-foamed plastic material and it supports thereon a radome 62. This heat insulating plate 63 is mounted on the top plate 12 and is then covered with the radome 62. In FIG. 21, arrows coming from the upward to the downward of the sheet of drawing indicate signal waves and solar heat at the same time.

FIG. 22 illustrates other practical examples of the whole arrangement of the circular patch-slot array antenna of the present invention.

As FIG. 22 shows, a heat insulating plate 64 is provided between the top plate 12 and the radome 62. This heat insulating plate 64 has openings 65 formed therethrough at positions corresponding to a number of slots 15 formed through the top plate 12. As a result, above the radiation elements 18 located on the film-shaped substrate 13, there exists only the radome 62 above the slots 15 of the top plate 12 and the openings 65 of the heat insulating plate 64, and hence there is no heat insulating material 64. Thus, the dielectric loss by the heat insulating material 64 is removed and hence the loss of signal power is reduced, thus increasing the receiving sensitivity of the circular patch-slot planar array antenna as compared with the case of FIG. 21.

The sum of the areas of the radiation elements 18 is about ½ of the whole antenna surface area. Further, the rise of temperature of the antenna by the sunlight shown by arrows in FIG. 22 is caused mainly by the rise of temperature in the top plate 12 so that the rise of temperature caused by the openings 65 formed through the heat insulating material 64 is sufficiently small enough that no problem is presented.

The above description is given on the preferred embodiments of the present invention and it will be apparent that many modifications and variations thereof could be effected by one with ordinary skill in the art without departing from the spirit and scope of the novel concepts of the invention so that the scope of the invention should be determined only by the appended claims.

We claim as our invention:

1. A suspended line feed type planar antenna comprising a substrate sandwiched between a pair of spaced apart conductive surfaces, said substrate being spaced from at least one of said surfaces, one of said surfaces having a plurality of spaced openings defining radiation elements, a corresponding plurality of resonance type patch radiators on said substrate in alignment with said plurality of openings respectively, feeding means for co-phase feeding said patch radiators, a suspended line interconnecting all of said patch radiators, said suspended line being formed as a printed circuit on said substrate and spaced between said two conductive surfaces, said substrate being made of a flexible material, and wherein at least a pair of positioning pins are provided on said two conductive surfaces, and openings engaged with said pair of positioning pins are formed through said substrate to selectively attach said substrate, whereby either of clockwise and counter-clockwise polarized waves is selectively supplied by attaching said substrate in selectively reversed condition.

2. A suspended line feed type planar antenna comprising a substrate sandwiched between a pair of spaced apart conductive surfaces, said substrate being spaced from at least one of said surfaces, one of said surface having a plurality of spaced openings defining radiation elements, a corresponding plurality of resonance type patch radiators on said substrate in alignment with said plurality of openings respectively, feeding means for co-phase feeding said patch radiators, said pair of conductive surface being formed on top and bottom plates respectively, and wherein said top and bottom plates are each formed of a flat plate having substantially no protrusion, and protrusions are respectively formed between said top plate and said substrate and between said bottom plate and said substrate at corresponding positions thereof, whereby said substrate is supported by said protrusions.

3. An antenna according to claim 2, wherein a pair of supporting members are provided between said top and bottom plates, and said protrusions are provided on said pair of supporting members.

4. An antenna according to claim 2, wherein said protrusions are secured to said top and bottom plates at their corresponding positions.

5. An antenna according to claim 2, wherein each of said protrusions is formed of a combination of a flange and a ring and said flange is engaged into each of said openings of the conductive surface.

6. An antenna according to claim 2 wherein said protrusions are provided on front and rear surfaces of said substrate.

7. A suspended line feed type planar antenna comprising a substrate sandwiched between a pair of spaced apart conductive surfaces, said substrate being spaced from at least one of said surfaces, one of said surfaces having a plurality of spaced openings defining radiation elements, a corresponding plurality of resonance type patch radiators on said substrate in alignment with said plurality of openings respectively, feeding means for co-phase feeding said patch radiators, and wherein signals from said plurality of radiators are respectively mixed through active elements and are supplied to said feed means and a DC bias voltages are supplied through said feeding means to said active elements, respectively.

8. A suspended feed type planar antenna comprising a substrate sandwiched between a pair of spaced apart conductive surfaces, said substrate being spaced from at least one of said surfaces, one of said surface having a plurality of spaced openings defining radiation elements, a corresponding plurality of resonance type patch radiators on said substrate in alignment with said plurality of openings respectively, feeding means for co-phase feeding said patch radiators, said pair of conductive surfaces are formed on top and bottom plate respectively, and wherein a groove a U-shaped cross section is formed at peripheral edge portions of said top and bottom plates to trap an undesired signal.

9. A suspended line feed type planar antenna comprising a substrate sandwiched between a pair of spaced apart conductive surfaces, said substrate being spaced from at least one of said surfaces, one of said surfaces having a plurality of spaced openings defining radiation elements, a corresponding plurality of resonance type patch radiators on said substrate in alignment with said plurality of openings respectively, feeding means for co-phase feeding said patch radiators, said pair of conductive surfaces are formed on top and bottom plates, respectively, and wherein said openings are formed through said top plate, and including a heat insulating plate and a radome provided on said top plate, and openings are formed through said heat insulating plate at positions aligned with said openings.

10. A suspended line feed type planar antenna comprising a substrate sandwiched between a pair of spaced-apart conductive surfaces, one of said surfaces having a plurality of spaced openings defining radiation elements, a corresponding plurality of circular wave radiators on said substrate in alignment with said openings, respectively, at least a pair of positioning pins formed on said pair of conductive surfaces, openings formed through said substrate so as to be engaged with said pair of positioning pins and feeding means for co-phase feeding of said radiators, characterized in that said substrate is selectively attached with its facing surface reversed, thus selecting one of the clockwise and counter-clockwise circular polarized waves and feeding said radiation elements.

11. A suspended line feed type planar antenna comprising a substrate sandwiched between a pair of conductive surfaces, one of said surfaces having a plurality of spaced openings defining radiation elements, a corresponding plurality of radiators formed as printed circuit elements on said substrate in alignment with said openings respectively, a suspended line interconnecting all of said radiators, said suspended line being formed as a printed circuit on said substrate, and feeding means for feeding said radiators, characterized by a protective film deposited on said substrate to cover said radiators and suspended line.

12. A suspended line feed type planar antenna comprising a substrate sandwiched between a pair of spaced-apart conductive surfaces, one of said surfaces having a plurality of spaced openings defining radiation elements, a corresponding plurality of radiators formed on said substrate in alignment with said openings respectively, top and bottom plates on which said conductive surfaces are formed, and means for feeding said radiators, characterized in that said top and bottom plates are each formed of a flat plate with substantially no protrusion and protrusions are formed at a corresponding plurality of positions between said top plate and said substrate and between said bottom plate and said substrate, thus said substrate being supported by said protrusions.

13. A suspended line feed type planar antenna comprising a substrate sandwiched between a pair of conductive surface, one of said surfaces having a plurality of spaced openings defining radiation elements, a corresponding plurality of radiators formed on said substrate in alignment with said openings, respectively, top and bottom plates on which said conductive surfaces are deposited, and means for feeding said radiators, characterized in that signals from said plurality of radiators are mixed by respective active elements and fed to said feeding means, and a DC bias voltage is supplied through said feeding means to each of said active elements.

14. A suspended line feed type planar antenna comprising a substrate sandwiched between a pair of conductive surfaces, one of said surfaces having a plurality of spaced openings defining radiation elements, a corresponding plurality of radiators formed on said substrate in alignment with said openings respectively, top and bottom plates on which said conductive surfaces are deposited, and means for feeding said radiators, characterized in that a U-shaped groove is formed at peripheral edge portions of said top and bottom plates to trap an undesired signal.

15. A suspended line feed type planar array antenna comprising a substrate sandwiched between a pair of conductive surfaces, one of said surfaces having a plurality of spaced openings defining radiation elements, a corresponding plurality of radiators formed on said substrate in alignment with said openings respectively, top and bottom plates on which said conductive surfaces are deposited, and means for feeding said radiators, characterized in that said openings are formed through said top plate, a heat insulating plate and a radome are formed on said top plate and openings are formed through said heat insulating plate at positions corresponding to said openings.

* * * * *